US009798291B2

(12) United States Patent
Martin et al.

(10) Patent No.: US 9,798,291 B2
(45) Date of Patent: Oct. 24, 2017

(54) MECHANICAL WRISTWATCH BRACELET WITH WHICH AN ELECTRONIC FUNCTION IS ASSOCIATED

(71) Applicant: The Swatch Group Research and Development Ltd, Marin (CH)

(72) Inventors: Jean-Claude Martin, Montmollin (CH); Jean-Jacques Born, Morges (CH); Thierry Conus, Lengnau (CH); Jean-Claude Eggen, Orpund (CH); Emmanuel Fleury, Moutier (CH); Michel Willemin, Pretes (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/215,799

(22) Filed: Jul. 21, 2016

(65) Prior Publication Data

US 2017/0102672 A1 Apr. 13, 2017

(30) Foreign Application Priority Data

Oct. 13, 2015 (EP) ..... 15189552

(51) Int. Cl.
*G04B 21/00* (2006.01)
*G04B 23/00* (2006.01)
(Continued)

(52) U.S. Cl.
CPC ..... *G04B 37/0008* (2013.01); *G04B 21/00* (2013.01); *G04B 23/00* (2013.01);
(Continued)

(58) Field of Classification Search
CPC ..... G04B 21/00; G04B 23/00; G04B 25/04; G04B 37/0008; G04C 21/00; G04G 13/00; G04G 21/04
See application file for complete search history.

(56) References Cited

U.S. PATENT DOCUMENTS 4,601,585 A * 7/1986 Farley ..... G04B 19/042 368/238
5,746,501 A * 5/1998 Chien ..... A01K 27/006 362/103
(Continued)

FOREIGN PATENT DOCUMENTS

CN 203812002 U 9/2014

OTHER PUBLICATIONS

European Search Report dated Apr. 21, 2016 in European Application 15189552, filed on Oct. 13, 2015 ( with English Translation of Categories of Cited Documents and Written Opinion).
(Continued)

*Primary Examiner* — Vit W Miska
(74) *Attorney, Agent, or Firm* — Oblon, McClelland, Maier & Neustadt, L.L.P.

(57) ABSTRACT

Wristwatch comprising a mechanical device for executing a first mechanical function arranged to produce a first acoustic alarm signal, and an electronic device housed in a bracelet and arranged to produce a second acoustic alarm signal and/or a mechanical vibration, wherein the electronic device is arranged to produce the second acoustic alarm signal at the moment when the mechanical device for executing the first mechanical function produces the first acoustic alarm signal.

31 Claims, 13 Drawing Sheets

(51) Int. Cl.

| | |
|---|---|
| ***G04B 25/04*** | (2006.01) |
| ***G04C 21/00*** | (2006.01) |
| ***G04G 13/00*** | (2006.01) |
| ***G04G 21/04*** | (2013.01) |
| ***G04B 37/00*** | (2006.01) |

(52) U.S. Cl.
CPC ..... *G04B 25/04* (2013.01); *G04C 21/00* (2013.01); *G04G 13/00* (2013.01); *G04G 21/04* (2013.01)

(56) References Cited

U.S. PATENT DOCUMENTS

| | | | | |
|---|---|---|---|---|
| 7,441,415 | B2 * | 10/2008 | Radley-Smith ..... | A44C 5/0015 345/46 |
| 2016/0004276 | A1 * | 1/2016 | Stroetmann ..... | G04G 9/007 361/679.03 |
| 2016/0306761 | A1 * | 10/2016 | Liu ..... | G06F 13/385 |

OTHER PUBLICATIONS

David Szondy "Kairos TBand turns almost any watch into a smartwatch", XP055262033, http;//www.gizmag.com/Kairos-tband/34811/, 2014, 3 pages.

* cited by examiner

MECHANICAL WRISTWATCH BRACELET WITH WHICH AN ELECTRONIC FUNCTION IS ASSOCIATED

This application claims priority from European Patent Application No 15189552.1 filed Oct. 13, 2015, the entire disclosure of which is hereby incorporated herein by reference.

FIELD OF THE INVENTION

The present invention concerns a watch case containing a mechanical timepiece movement and a watch bracelet or strap associated with the watch case in a removable manner, the watch bracelet containing an electronic device for performing an electronic function which supplements or improves the mechanical function(s) performed by the mechanical timepiece movement housed in the watch case.

BACKGROUND OF THE INVENTION

It is known that users feel affection for their mechanical watches. Indeed, mechanical timepiece movements are synonymous with a high level of expertise, notably in terms of miniaturisation, precision made components, decoration, reliability of operation in sometimes extreme conditions and the choice of timepiece complications offered, values that are less commonly found in the field of electronic watches. However, there are functions, for example lighting, offered by electronic watches which are not available in purely mechanical watches. This is why there is a strong trend to associate purely mechanical watches with one or more additional electronic functions, without, however, requiring any modification to the mechanical timepiece movement.

To achieve this object, it has already been proposed to incorporate electronic devices in mechanical watch bracelets or straps to execute additional electronic functions which will add to the functions performed by the mechanical timepiece movement of the wristwatch. The E-Strap® marketed by Montblanc can be cited as an example of this. Consequently, the mechanical watch and the emotional value attached by the user to such a watch remain unchanged, while additional functions, only offered by electronic devices, can also be enjoyed.

It is understood from the foregoing that the object of watch bracelets of the aforementioned type, which incorporate electronic devices, is to offer at least one additional electronic function which adds to the functions performed by the mechanical watch movement. In other words, the execution of a mechanical function by the mechanical timepiece movement contained in the watch case is totally independent of the execution of an electronic function by the electronic device housed in the thickness of the bracelet or in the clasp closing the bracelet and vice versa, such that it is entirely possible to envisage associating a given bracelet with watch cases from different brands.

However, to the Applicant's knowledge, it appears that there is no watch bracelet or strap currently on the market that incorporates an electronic device, wherein the execution of the function for which it is intended will depend on the corresponding execution of a function ensured by the mechanical timepiece movement.

SUMMARY OF THE INVENTION

It is an object of the present invention to associate a mechanical wristwatch arranged to execute at least a first mechanical function, with an electronic device arranged to execute at least a second electronic function, the execution of the second electronic function by the electronic device being dependent on the execution of the first mechanical function by the timepiece movement.

To this end, the present invention concerns a wristwatch comprising a watch case in which is housed a mechanical timepiece movement comprising a mechanical device for executing at least a first mechanical function, the watch case being associated with a watch bracelet or strap in which is housed an electronic device arranged to execute at least a second electronic function, the execution of the second electronic function being dependent on the execution of the first mechanical function.

According to a preferred embodiment of the invention, the mechanical device for executing the first mechanical function is a mechanical striking device arranged to produce a first acoustic alarm signal, and the electronic device housed in the bracelet is arranged to produce a second acoustic alarm signal and/or a mechanical vibration, the electronic device being arranged to produce the second acoustic alarm signal at the moment when the mechanical striking device produces the first acoustic alarm signal. It is also possible to envisage offsetting in time, by a fixed duration or user-selectable duration, the activation of the second acoustic alarm signal.

As a result of these features, the present invention provides a mechanical wristwatch comprising a mechanical timepiece movement provided with a mechanical device which is arranged to execute a mechanical function and is associated with an electronic device housed in the thickness of the bracelet and arranged to execute an electronic function at the precise moment when the mechanical device of the mechanical timepiece movement executes the mechanical function. It is thus understood that, in such an arrangement, the mechanical timepiece movement acts as the master device and the electronic device housed in the bracelet acts as the slave device.

A "mechanical wristwatch" means a wristwatch whose time-related and, where appropriate, non-time-related functions are ensured only by mechanical components which are supplied with the energy required for operation by one or more mainsprings.

An "electronic device" means a device whose functions are ensured only by electrical or electronic components which are supplied with the energy required for operation by a battery or an accumulator which may be rechargeable.

In the preferred embodiment of the invention, the mechanical device for executing a first mechanical function is a mechanical striking device arranged to produce a first acoustic alarm signal, and the electronic device housed in the bracelet is arranged to produce a second acoustic alarm signal and/or a mechanical vibration. Thus, when the mechanical striking device emits its acoustic alarm signal, the electronic device emits its own acoustic and/or mechanical alarm signal simultaneously, or after a delay.

The electronic device housed in the bracelet thus makes it possible to improve the operating performance of the mechanical striking device, notably in terms of the acoustic power generated and the melody through the selection and combination of frequencies. This is very advantageous since, currently, the sound level produced by a timepiece movement equipped with a mechanical striking device is low, typically comprised between 65 and 75 dB at a distance of 40 cm. This is due, in particular, to dimensional and sound propagation constraints imposed by the geometry of the watch case and the material of which it is made, and to the limited amount of available mechanical energy, even in the case where the mechanical striking device is powered by a mainspring which is specific thereto. Moreover, the duration of the acoustic alarm signal usually does not exceed 10 to 20 seconds, and a drop in the intensity of the acoustic signal is observed when the mainspring is almost completely let down.

In the case where the watch case comprises a transparent back, the electronic device for executing the second electronic function comprises an image sensor, typically of the CMOS type (complementary metal oxide semiconductor), arranged inside the bracelet to be under the transparent case back. In such case, it is also possible to arrange a light source in the bracelet to improve the conditions in which the image sensor takes shots.

The image sensor is arranged to scan, at close regular intervals, the indication provided by the mechanical striking mechanism. As soon as the image sensor detects the mechanical striking device starting and emitting the first acoustic alarm signal, it sends an electrical signal to an electronic control unit which actuates an electronic sound generator. Thus, the acoustic alarm signal produced by the mechanical striking device is reinforced by the electronic alarm signal, which makes it possible to increase acoustic power and thereby improve the audibility of the acoustic alarm signal produced by the mechanical wristwatch according to the invention. This can also enrich the sonority of the acoustic alarm produced by the mechanical device by creating a polyphonic sound. In order for the image sensor to detect the moment at which the mechanical striking device starts to operate and produces the first acoustic alarm signal, the image sensor is arranged to scan, at close regular intervals, a component of the mechanical striking device which is normally immobile and which is only set in motion at the moment when the mechanical striking device emits the first acoustic signal. This component may be, for example, a strike pallets which pivots in a horizontal plane about its point of articulation.

In the case where the watch case comprises an opaque, non-electrically conductive back, the electronic device for detecting the indication provided by the mechanical striking device comprises a capacitive, magnetic or inductive sensor.

In the case of the capacitive sensor, this typically comprises an RC oscillator, a demodulator and an output stage. The operation of such a capacitive sensor occurs without any physical contact with the mechanical striking device and relies on an electric field change in its active area. The capacitive sensor, disposed under the back of the watch case, detects a certain capacitance value which remains fixed as long as the mechanical striking device is at rest. At the moment when the mechanical striking device starts to operate and emits the first acoustic alarm signal, the capacitive sensor detects a capacitance change caused by the start of operation of the mechanical striking device, which causes a variation in the oscillation frequency of the RC circuit. Detection of this frequency variation generates an electrical output signal which is sent to the electronic control unit which actuates the electronic sound generator.

Likewise, the magnetic sensor detects a magnetic field change caused by the start of operation of the mechanical striking mechanism. By way of non-limiting example, this magnetic sensor may be a giant magnetoresistive sensor, for example marketed by the American company NVE and also known as a giant magnetoresistive digital switch or GMR. Magneoresistance is the property that some materials have to change the value of their electrical resistance when they are subjected to a magnetic field. Thus, a giant magnetoresistive sensor is arranged to output an electrical control signal as a function of a variation in the magnetic field to which it is subjected. The NVE sensor is a very low power sensor which works through transparent case backs (sapphire, Plexiglas, glass) or opaque non-magnetic case backs (stainless steel, titanium, aluminium, brass, ceramic, plastic). It may also be a reed switch with flexible reeds. To this end, at least one of the components of the mechanical striking device, which starts to move when the mechanical striking device starts to operate, is provided with a magnet. Thus, when the component moves, the magnet is moved concomitantly which, in the case of the reed switch, magnetizes the flexible contacts which attract each other and come into contact with each other. The reed switch is then closed and can send an electrical output signal to the electronic control unit which actuates the electronic sound generator.

Finally, the inductive sensor conventionally comprises a winding made around a magnetic circuit whose role is to channel the magnetic field. At least one component of the mechanical striking device, which starts to move when the mechanical striking device starts to operate, is provided with a magnet. Thus, when the mechanical striking device starts to operate, the magnet moves and induces an electrical current in the winding of the inductive sensor. The inductive sensor sends an electrical output signal to the electronic control unit which actuates the electronic sound generator.

Whether the watch case back is transparent or opaque, conductive or non-conductive of electricity, the electronic device for detecting the indication provided by the mechanical striking device may comprise a simplified device comprising a microphone, which simply detects the acoustic wave produced by the start of operation of the mechanical striking device and sends an electrical signal to the electronic control unit which actuates the electronic sound generator.

Likewise, regardless of the properties of the watch case back, it is possible to envisage using as a sensor an accelerometer which will measure the activity of the mechanical striking device and detect the moment at which it starts to operate.

According to a complementary feature of the invention, the mechanical device for executing the first mechanical function housed in the watch case comprises a mechanical indicator member which provides an indication as to whether the mechanical device for executing the first mechanical function is in a set or non-set state, and the electronic device comprises first means arranged to scan the indication provided by the mechanical indicator member and second means which are arranged to scan the moment at which the first mechanical function will start.

BRIEF DESCRIPTION OF THE DRAWINGS

Other features and advantages of the present invention will appear more clearly from the following detailed description of an embodiment example of a mechanical wristwatch according to the invention with which an electronic function is associated, this example being given solely by way of non-limiting illustration with reference to the annexed drawing, in which.

DETAILED DESCRIPTION OF ONE EMBODIMENT OF THE INVENTION

The present invention proceeds from the general inventive idea that consists in associating a mechanical wristwatch, devised to execute a first mechanical function in addition to the current time display, with a bracelet, in the thickness of which is housed an electronic device devised to execute a second electronic function, the execution of the second electronic function being dependent on by the execution of the first mechanical function. In a preferred but non-limiting embodiment of the present invention, the mechanical wristwatch is arranged to emit a first acoustic alarm at a predetermined moment programmed by the user, and the electronic device housed in the bracelet is arranged to emit a second acoustic alarm and/or a mechanical vibration at the moment when the watch emits the first acoustic alarm. It is therefore possible to increase the acoustic power of the alarm signal produced by the wristwatch according to the invention without requiring any modification to be made to the mechanical movement housed in the watch. It is also possible to increase the duration of the alarm signal and to emit sounds other than those produced by the mechanical movement, in harmony with such sounds.

Figure 1:
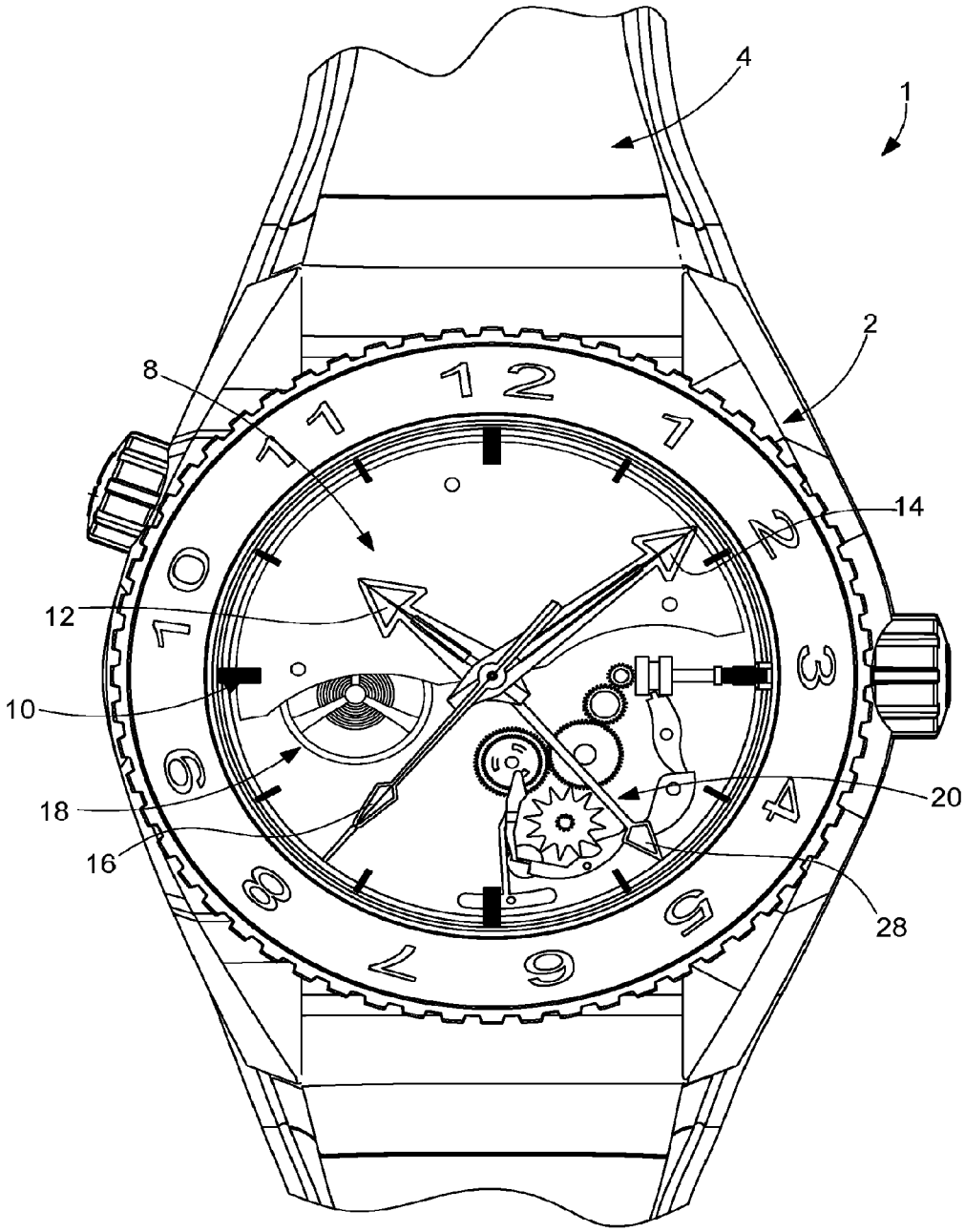
FIG. 1 is a bottom view of an embodiment example of a wristwatch according to the invention comprising a watch case equipped with a bracelet having an electronic function.
Figure 2:
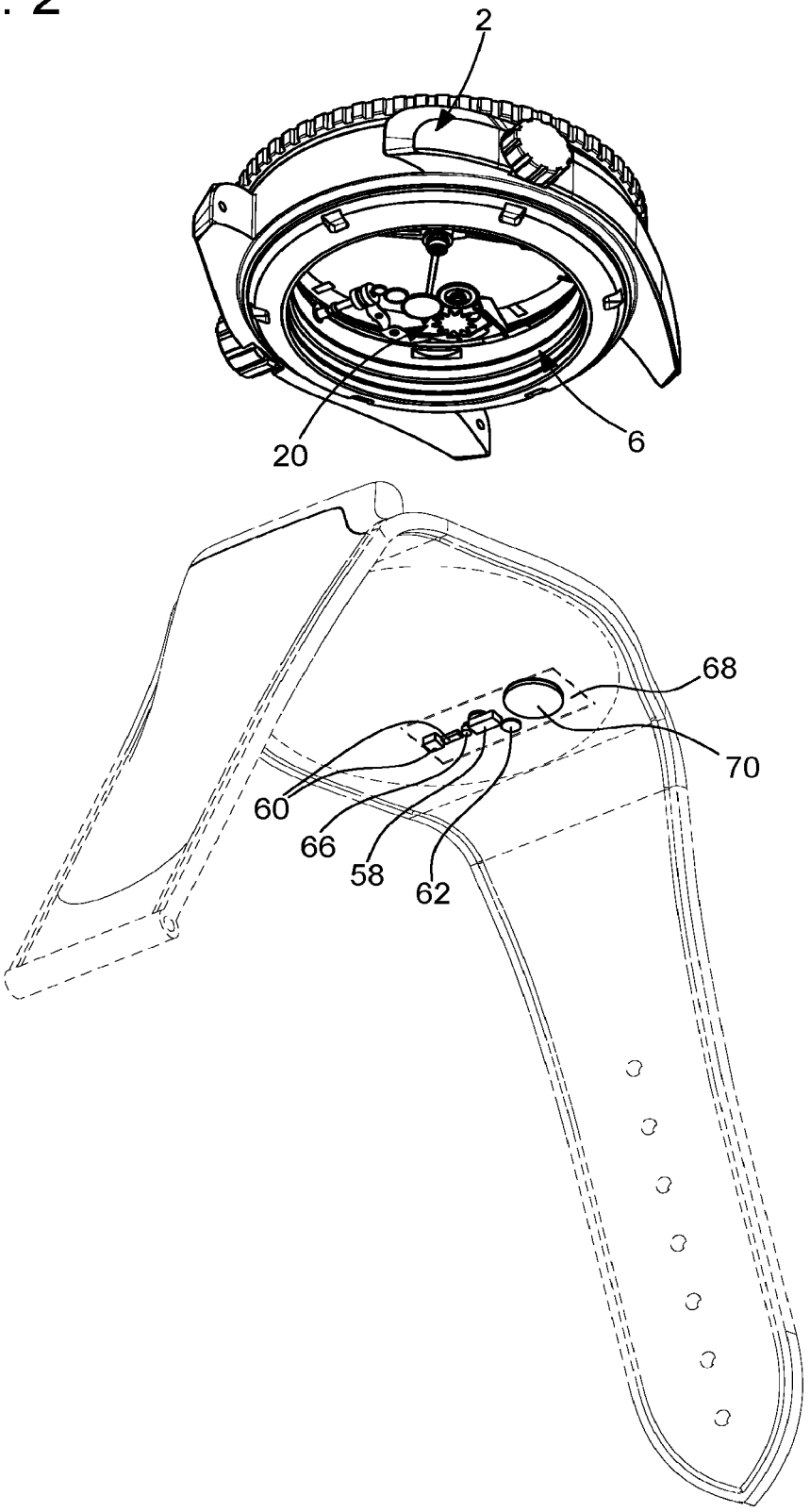
FIG. 2 is a perspective bottom view of the wristwatch of FIG. 1.

Designated as a whole by the general reference numeral 1, the wristwatch according to the invention comprises (see FIGS. 1 and 2) a watch case 2 devised to be worn on a user's wrist by means of a bracelet 4. In the preferred but non-limiting embodiment of the invention, the base of watch case 2 is closed by a back cover 6 and the top is closed by a crystal 8 which covers a dial 10 above which move the hour hand 12, minute hand 14 and seconds hand 16 for the current time display. In the example represented in FIG. 1, dial 10 is illustrated transparently. It is evident, however, that for the purposes of the present invention, dial 10 is not required to be transparent and will preferably be opaque.

A mechanical timepiece movement 18, devised to drive the current time display hands 12, 14, 16, is housed in watch case 2. This mechanical timepiece movement 18 further includes a mechanical device 20 arranged to produce at least a first mechanical function, for example to emit a first acoustic alarm signal.

Figure 3:
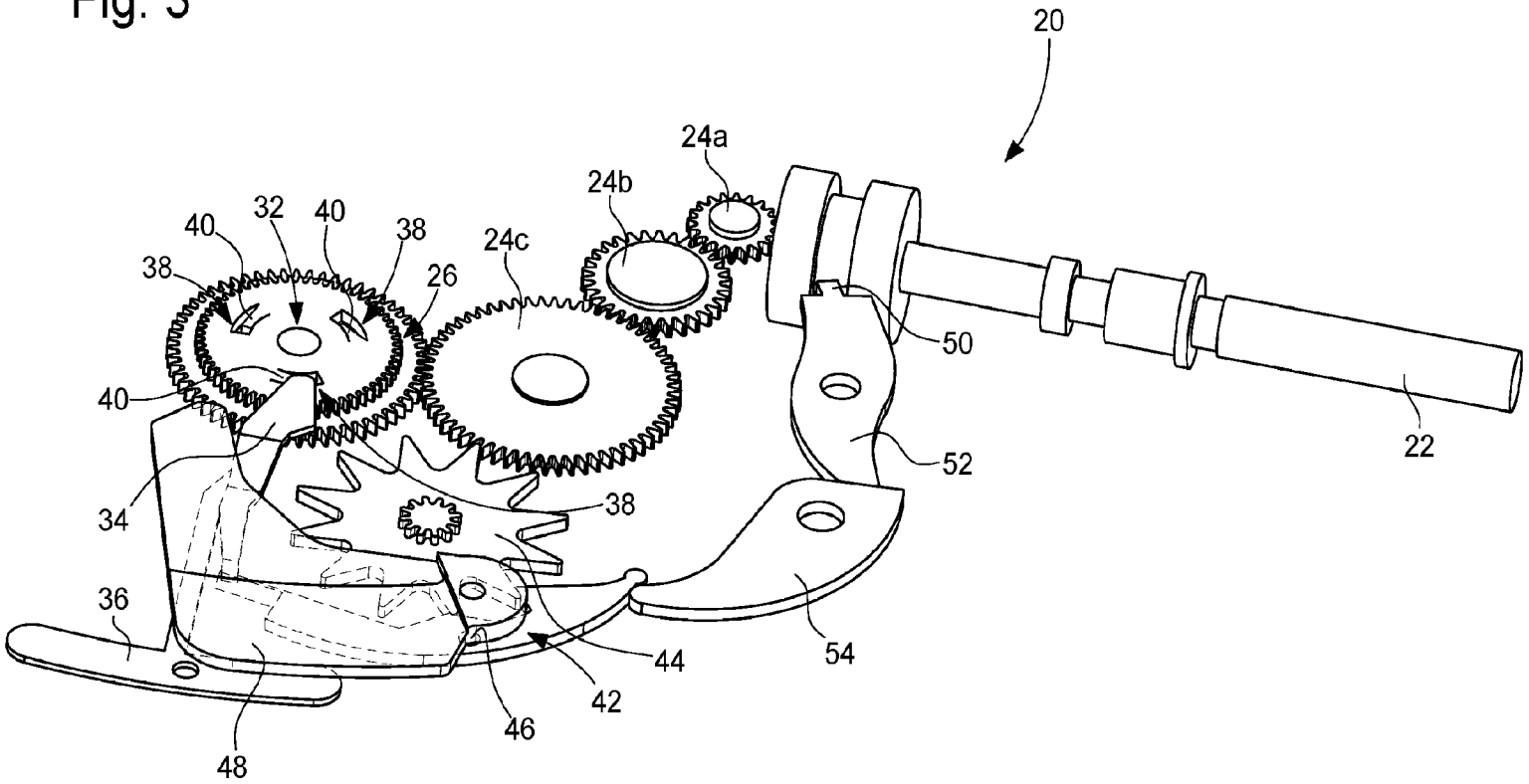
FIG. 3 is a perspective view of an embodiment example of the mechanical striking device.
Figure 9:
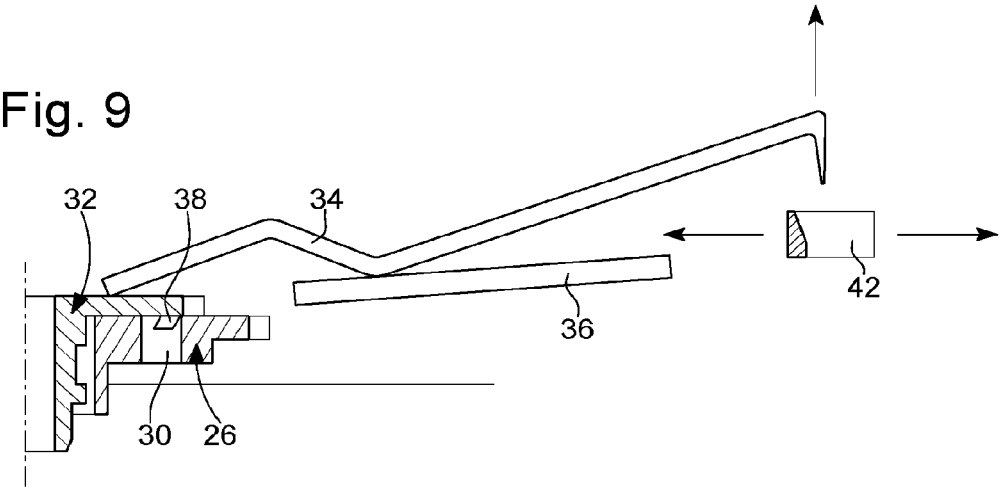

Purely by way of example (see FIG. 3), mechanical striking device 20 comprises a winding stem 22 which via first, second and third intermediate wheels 24*a*, 24*b* and 24*c*, rotates a release wheel 26. The tube of release wheel 26 carries or is kinematically connected to an index 28 seen in FIG. 1, which can be placed facing the desired alarm time. The plate of release wheel 26 is pierced with three openings 30 placed on three different radii (see FIG. 9). An hour wheel 32 pivots above release wheel 26 and is pressed against release wheel 26 by a release lever 34 wound by a spring 36. The plate of hour wheel 32 has three catches 38, each provided with an inclined plane 40. Hour wheel 32, driven by the movement, rotates and, at the set alarm time, the three catches 38 are positioned facing openings 30 and fall therein, such that hour wheel 32 is pressed against release wheel 26. As a result of this movement, release lever 34 tilts upwards and releases a strike pallets 42 which, driven by a strike wheel 44, starts to oscillate in a horizontal plane about its pivot point 46 (see FIG. 9). Strike wheel 44, which is directly driven by a strike barrel (not shown), acts like an escape wheel that drives strike pallets 42. Strike pallets 42 carries a hammer 48 which strikes a pin fixed at the back of the case to sound the alarm. The end of a rocking lever 50 for winding the striking mechanism is in contact with a slide lever 52 which acts on a strike lock 54. Strike lock 54 immobilises strike pallets 42 when winding stem 22 is in the time-setting position.

Figure 4A:
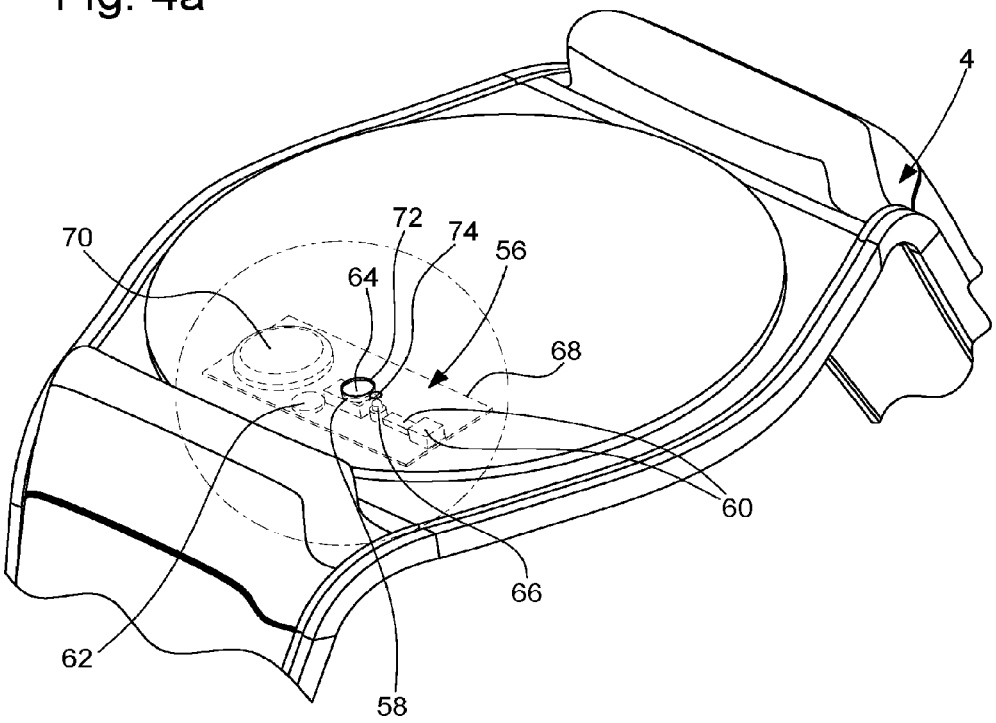
FIG. 4*a* is a perspective view of the bracelet in which is housed the electronic device arranged to execute the second electronic function.
Figure 4B:
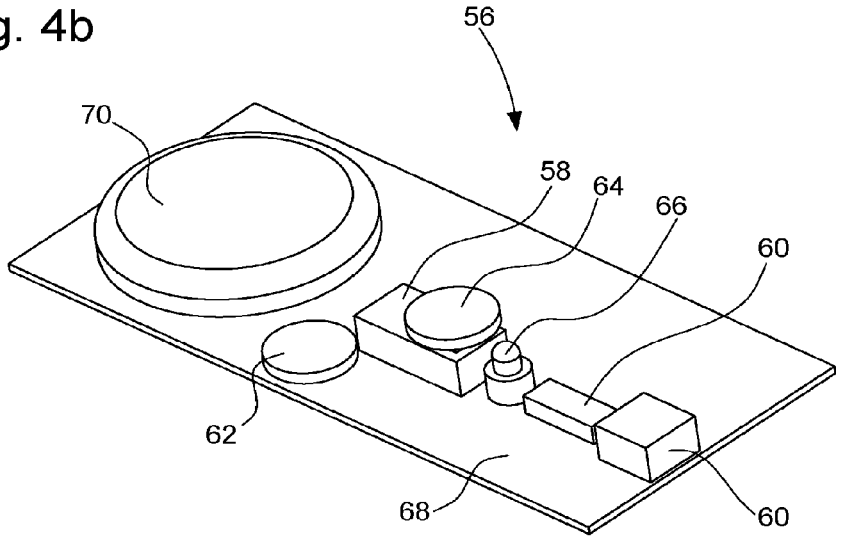
FIG. 4*b* is a larger scale view of the electronic device surrounded by a circle in FIG. 4*a*.

As shown in FIGS. 4*a* and 4*b*, an electronic device 56 housed in bracelet 4 is arranged to execute at least a second electronic function, for example to emit a second acoustic alarm signal and/or to produce a mechanical vibration, the execution of the second electronic function being dependent on the execution of the first mechanical function. In other words, electronic device 56 will emit the second acoustic alarm signal and/or produce a mechanical vibration at the moment when mechanical striking device 20 produces the first acoustic alarm signal. Mechanical striking device 20 housed in watch case 2 is thus the master of electronic device 56 which acts as the slave. It will be noted that the master function is not dependent on slave function and can operate normally even if the slave function is not in operation. It will also be noted that, according to a variant, it is possible to envisage offsetting, by a fixed duration, for example 5 or 10 seconds, or a duration selected by the user, the moment when electronic device 56 will start and produce the second acoustic signal.

Figure 5:
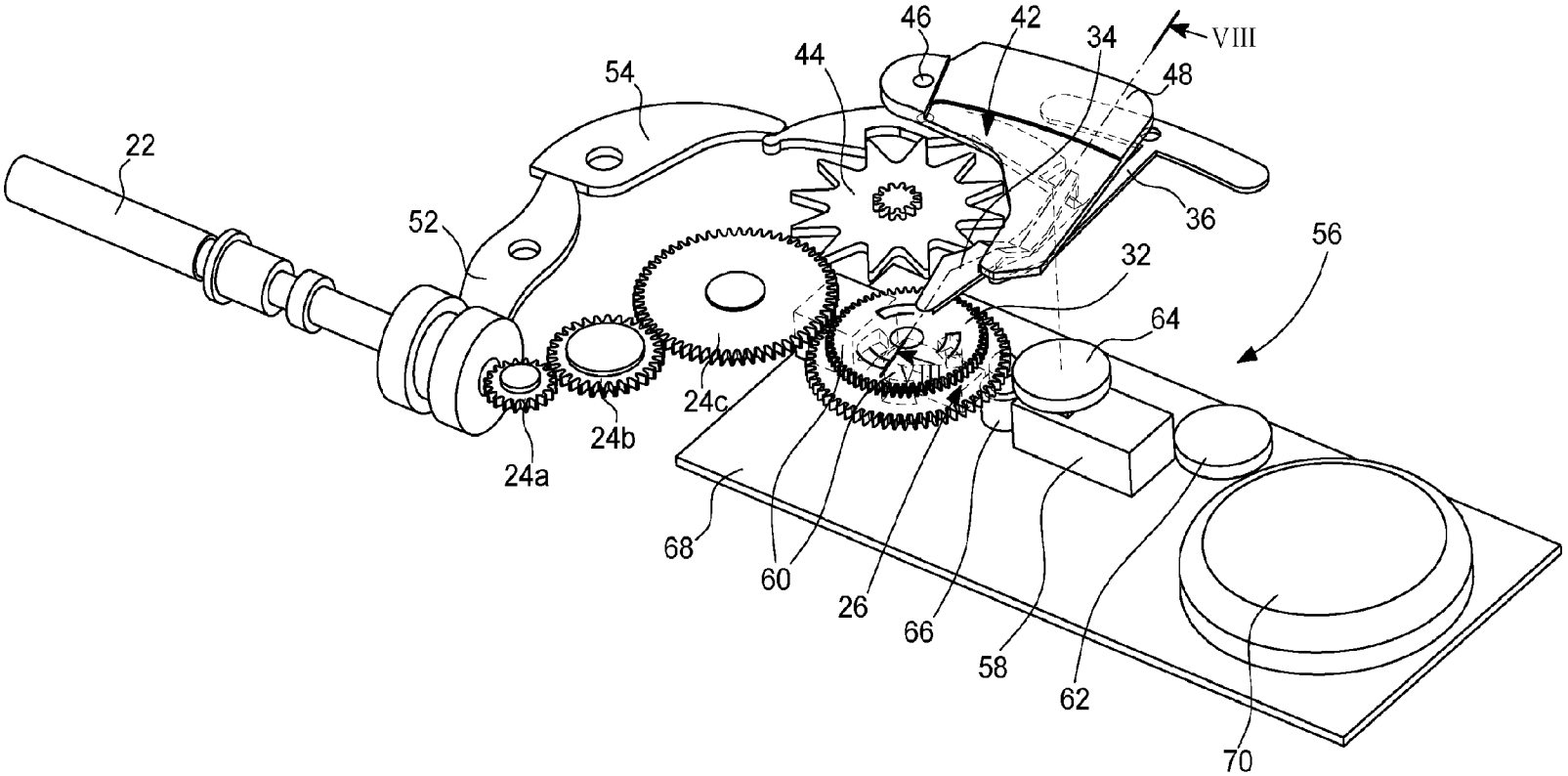
FIGS. 5, 6 and 7 schematically illustrate the assembly formed by the mechanical device arranged to produce the first acoustic alarm signal and the electronic device arranged to produce the second acoustic alarm signal according to whether the mechanical striking device is at rest, in operation, and then stopped again.
Figure 6:
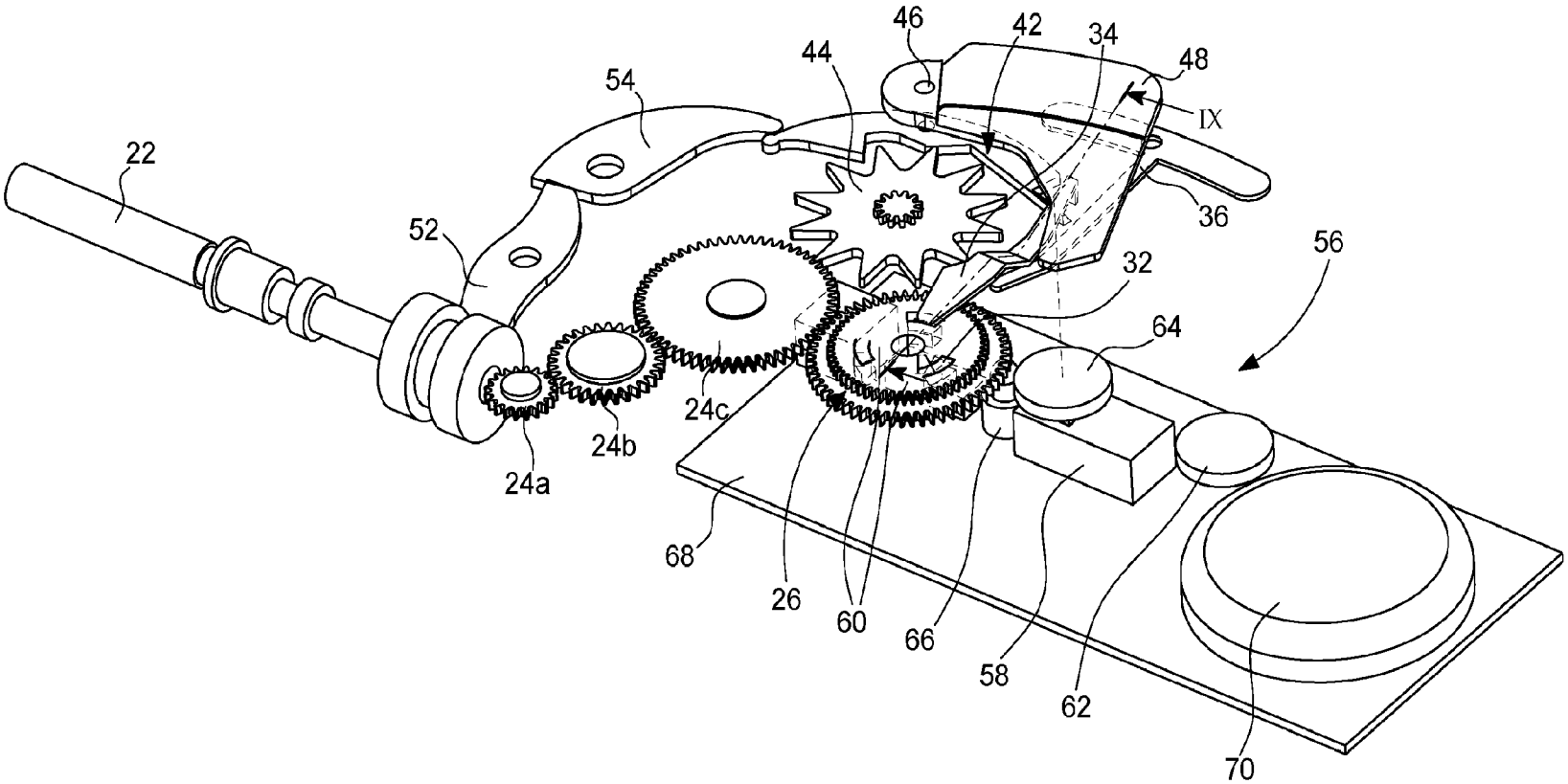
Figure 8:
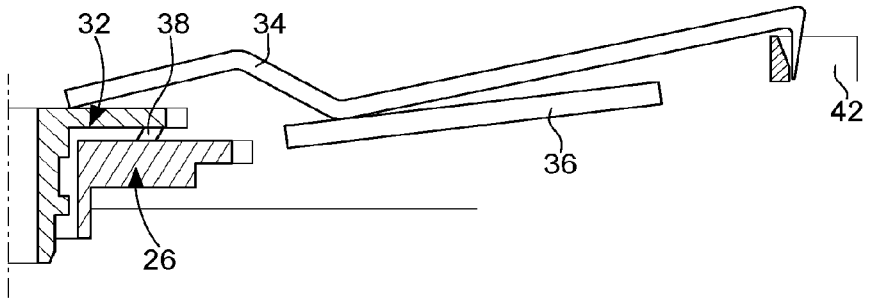
FIGS. 8 and 9 are cross-sectional views respectively along the lines VIII-VIII and IX-IX of FIGS. 5 and 6.

Electronic device 56 housed in bracelet 4 of wristwatch 1 comprises an image sensor 58 which scans, at close regular intervals, for the moment when mechanical striking device 20 starts to operate. Mechanical striking device 20 is initially at rest (FIGS. 5 and 8). At the moment when mechanical striking device 20 starts to operate (FIGS. 6 and 9), hour wheel 32 presses against release wheel 26 and release lever 34, pressed against hour wheel 32 by spring 36, pivots upwards, releasing strike pallets 42, which starts to oscillate in the horizontal plane about its pivot point 46. Hammer 48, carried by strike pallets 42, follows the motion of the latter and strikes for example a pin. Image sensor 58 detects the start of motion of a movable element of the mechanical striking device, such as strike pallets 42, and sends an electrical signal to a control unit 60 which will actuate an electronic sound generator 62 of the electromechanical or piezoelectric type. Advantageously, image sensor 58 is covered by a collimator lens 64, and a light source 66, such as a light emitting diode, illuminates the inside of watch case 2 through transparent case back 6. All these electronic components are mounted on a printed circuit sheet 68 housed in the thickness of bracelet 4 and are powered by an electrical current source 70. Naturally, openings 72 and 74 are provided above image sensor 58 and light source 66 in the material forming bracelet 4, so as to allow image sensor 58 to scan mechanical striking device 20, and to allow light source 66 to illuminate the scene.

Figure 7:
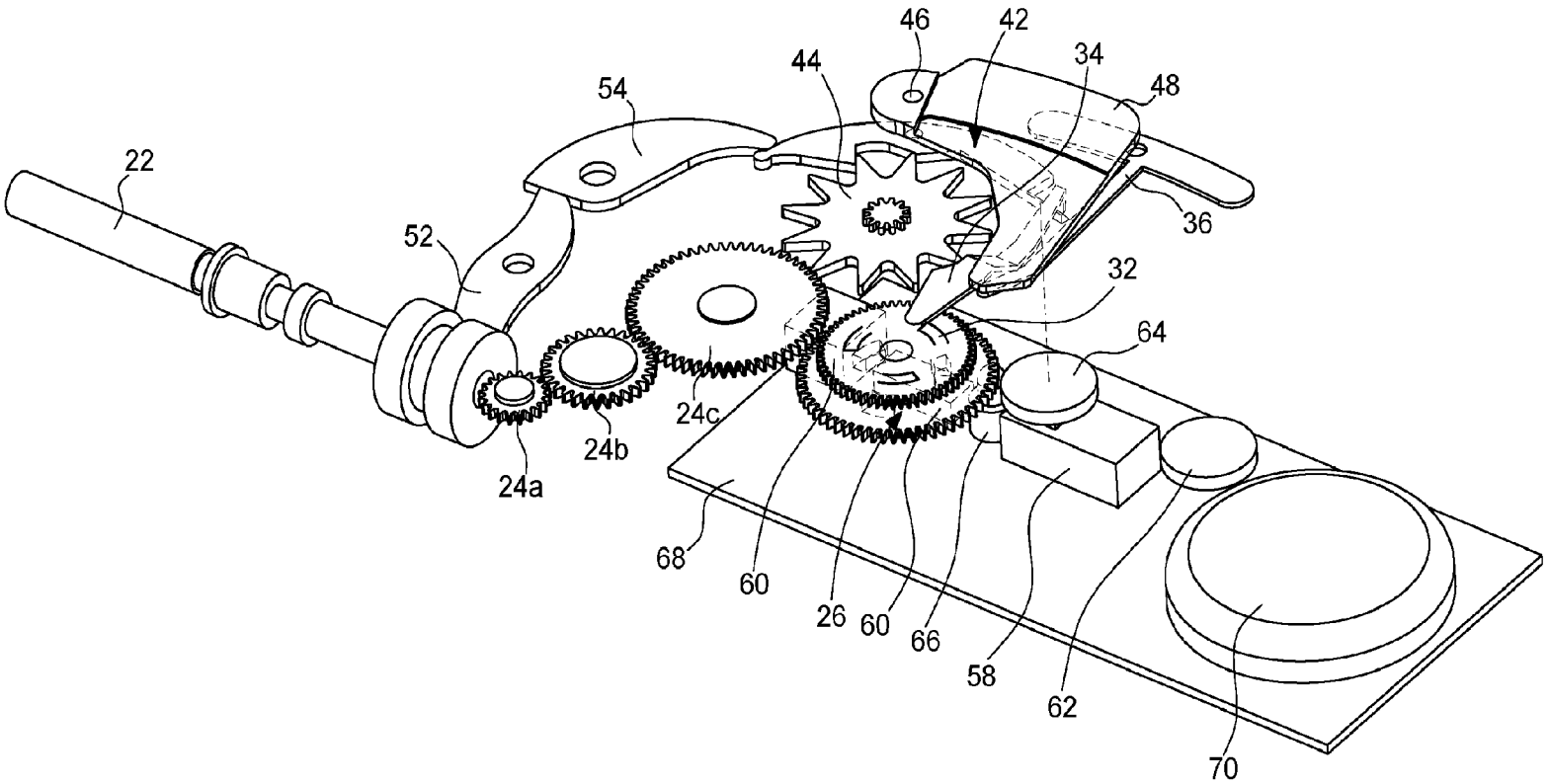

Image sensor 58 is, for example, an image sensor marketed by ST Microelectronics under the reference VD5376. It has a thickness comprised between 180 μm and 725 μm, sides respectively measuring 1900 μm and 1932 μm and an active surface of 608×608 $\mu m^2$ formed of a 20×20 pixel matrix. Such an image sensor 58 is capable of detecting a change in the levels of grey in an image that it scans and thus of detecting, for example, the displacement of an object such as strike pallets 42. It will be understood that image sensor 58 can detect the start of motion of another movable element, such as strike wheel 44, or hammer 48. Another change is observed by image sensor 58 when the first acoustic alarm signal stops and the movable element scanned by image sensor 58 stops (FIG. 7). The image that image sensor 58 sees in fact becomes immobile again. Image sensor 58 then sends an electrical signal to control unit 60 which will stop electronic sound generator 62.

According to a simplified variant of the invention, it may be envisaged to set the duration of the second alarm in advance. Once started after the activation of the first alarm, the second alarm will stop independently once this time has elapsed It is noted that a comparison of FIGS. 5 and 6 reveals that, in FIG. 6, hour wheel 32 is pressed against release wheel 26 and that in FIG. 7, hour wheel 32 has moved away from release wheel 26 again.

In the case where watch case 2 comprises an opaque, non-electrically conductive back 6, electronic device 56 for detecting the indication provided by mechanical striking device 20 comprises a capacitive, magnetic or inductive sensor.

Figure 10:
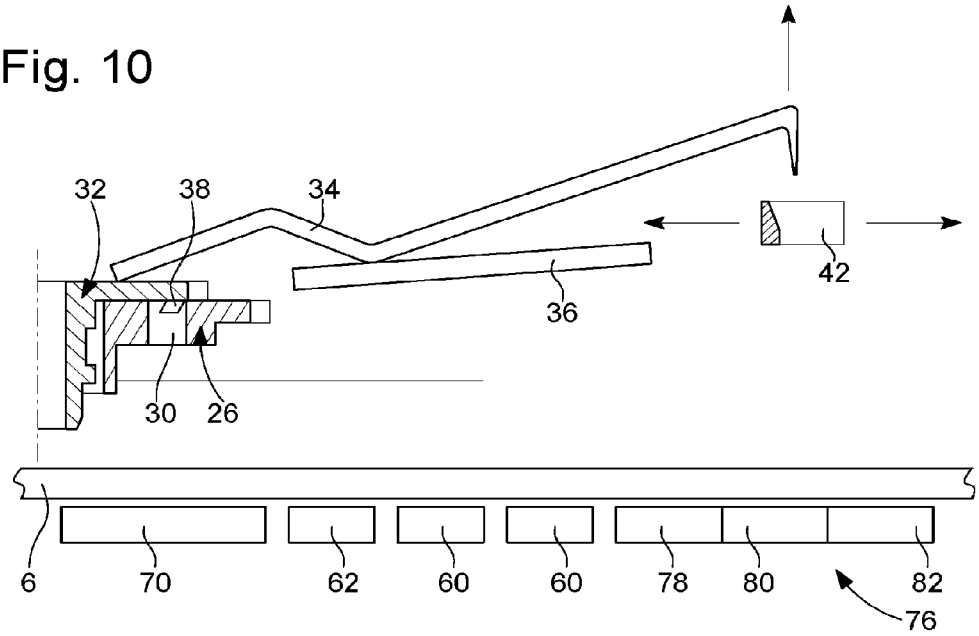
FIG. 10 is a partial schematic view of the watch case according to the invention in the case where the back cover of the watch is opaque and non-electrically conductive and where the electronic device arranged to execute the second electronic function comprises a capacitive sensor.

In the case of a capacitive sensor 76 (FIG. 10), this typically comprises an RC oscillator 78, a demodulator 80 and an output stage 82. The operation of such a capacitive sensor 76 occurs without any physical contact with mechanical striking device 20 and relies on an electric field change in its active area. Capacitive sensor 76, disposed under the watch case back, detects a certain capacitance value which remains fixed as long as mechanical striking device 20 is at rest. At the moment when mechanical striking device 20 starts to operate and emits the first acoustic alarm signal, capacitive sensor 76 detects a capacitance change caused by the start of operation of the mechanical striking device 20, which causes a change in the oscillation frequency of RC circuit 78. Following detection of this frequency variation, an electrical output signal is generated and sent to electronic control unit 60 which actuates the electronic sound generator. By way of example, the capacitive sensor may be the sensor marketed by the Swiss company EM-Microelectronic under the reference EM6420. This is a very low-power capacitive sensor able to operate with both transparent case backs (sapphire, Plexiglass, glass) and opaque non-metal case backs (plastic, ceramic). The EM6420 circuit must be connected to an electrode which will be placed inside the bracelet facing the metal part that will be set in motion when the alarm is activated.

Figure 11:
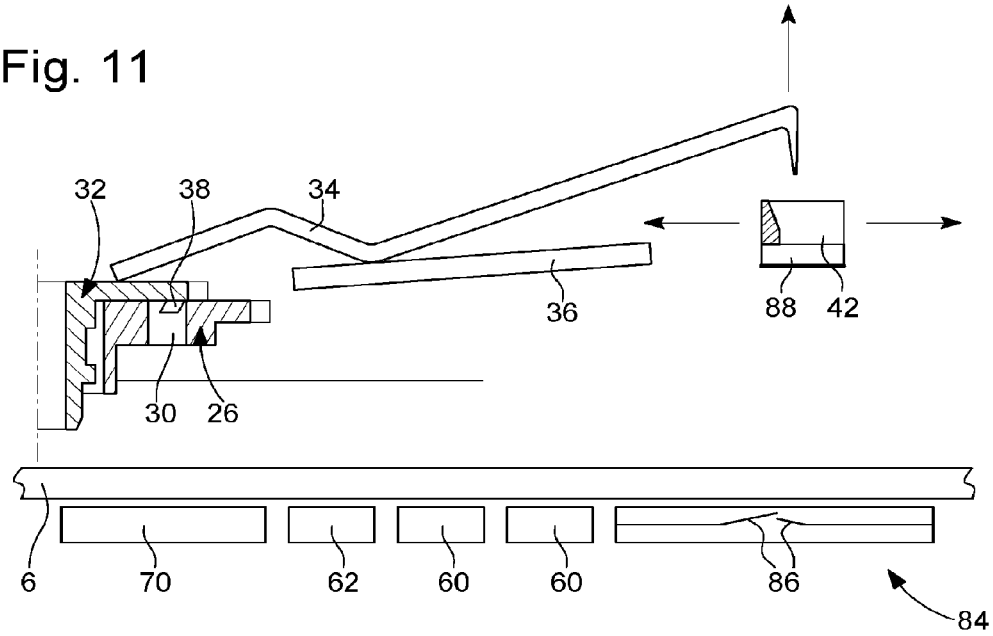
FIG. 11 is a partial schematic view of the wristwatch in the case where the back cover of the watch is opaque and non-electrically conductive and where the electronic device arranged to execute the second electronic function comprises a magnetic sensor.

Likewise, (FIG. 11), the magnetic sensor, such as a GMR sensor marketed by NVE or a reed switch 84 with flexible reeds 86, detects a change in the magnetic field caused by the start of operation of mechanical striking mechanism 20. To this end, at least one of the components of mechanical striking device 20, for example strike pallets 42, which starts to move when mechanical striking device 20 starts to operate, is provided with a magnet 88. Thus, when the component moves, magnet 88 is moved concomitantly which magnetizes the flexible contacts 86 which attract each other and come into contact with each other. Reed switch 84 is then closed and can send an electrical output signal to electronic control unit 60 which actuates electronic sound generator 62.

Figure 12:
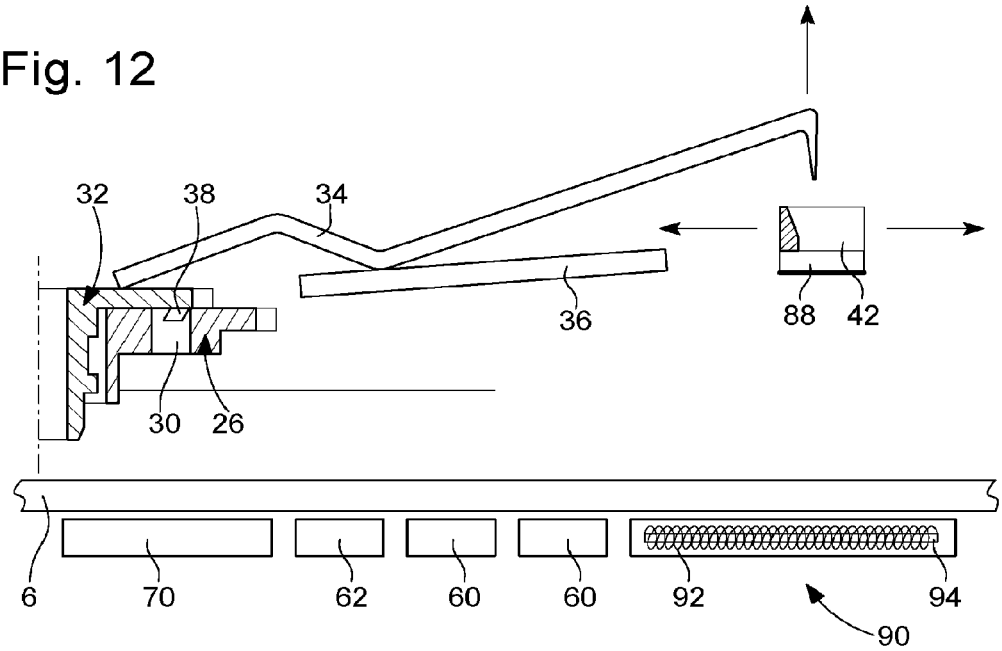
FIG. 12 is a partial schematic view of the wristwatch in the case where the back cover of the watch is opaque and non-electrically conductive and where the electronic device arranged to execute the second electronic function comprises an inductive sensor.

Finally, (FIG. 12), inductive sensor 90 conventionally comprises a winding 92 made around a magnetic circuit 94 whose role is to channel the magnetic field. At least one component of mechanical striking device 20, for example strike pallets 42, which starts to move when mechanical striking device 20 starts to operate, is provided with a magnet 88. Thus, when mechanical striking device 20 starts to operate, magnet 88 moves and induces an electrical current in winding 92 of inductive sensor 90. Inductive sensor 90 sends an electrical output signal to electronic control unit 60 which actuates electronic sound generator 62.

By way of variant, the inductive sensor may comprise an LC oscillator circuit whose inductance will vary under the effect of the displacement of a metal component of the mechanical device.

Figure 13:
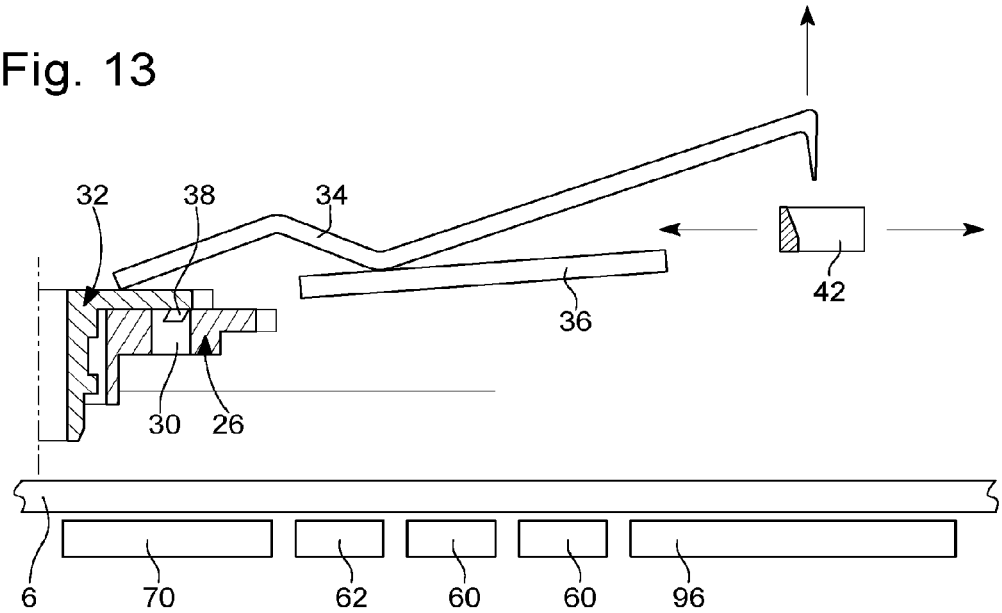
FIG. 13 is a partial schematic view of the wristwatch in the case where the watch case comprises an opaque electrically conductive back cover and wherein the electronic device for detecting the indication provided by the mechanical striking device comprises a simplified device comprising a microphone, which detects the acoustic wave produced by the start of operation of the mechanical striking device and sends an electrical signal to the electronic control unit that controls the start of operation of the electronic sound generator.

Whether the back 6 of watch case 2 is transparent or opaque, conductive or non-conductive of electricity (FIG. 13), electronic device 56 for detecting the indication provided by mechanical striking device 20 may comprise a simplified device comprising a microphone 96, which simply detects the acoustic wave produced by the start of operation of mechanical striking device 20 and sends an electrical signal to electronic control unit 60 which actuates electronic sound generator 62.

Likewise, regardless of the properties of back 6 of watch case 2, it may be envisaged to use as a sensor an accelerometer which will measure the activity of the mechanical striking device and detect the vibrations generated by hammer 48 at the moment when the mechanical striking device starts to operate. One accelerometer that is well suited to the requirements of the present invention is marketed under the reference ADXL362. This is a very low power circuit which constitutes an advantageous alternative to the microphone, particularly from the point of view of sealing and incorporation costs.

As seen in detail hereinbefore, electronic device 56 housed in bracelet 4 is arranged to execute at least a second electronic function, for example to emit a second acoustic alarm signal and/or to produce a mechanical vibration, the execution of the second electronic function being determined by the execution of the first mechanical function. In other words, electronic device 56 will emit the second acoustic alarm signal and/or produce a mechanical vibration at the moment when mechanical striking device 20 produces the first acoustic alarm signal. Mechanical timepiece mechanism 18 housed in watch case 2 is thus the master of electronic device 56 which acts as the slave.

According to a complementary feature of the invention, mechanical device 20 for executing the first mechanical function, housed in watch case 2, further comprises a mechanical indicator member 98 which provides an indication as to whether mechanical device 20 for executing the first mechanical function is in a set or non-set state. Thus, if mechanical device 20 is set by the user to produce an acoustic alarm signal at a predetermined time selected by the user, mechanical indicator member 98 will indicate that mechanical device 20 is set.

Figure 14A:
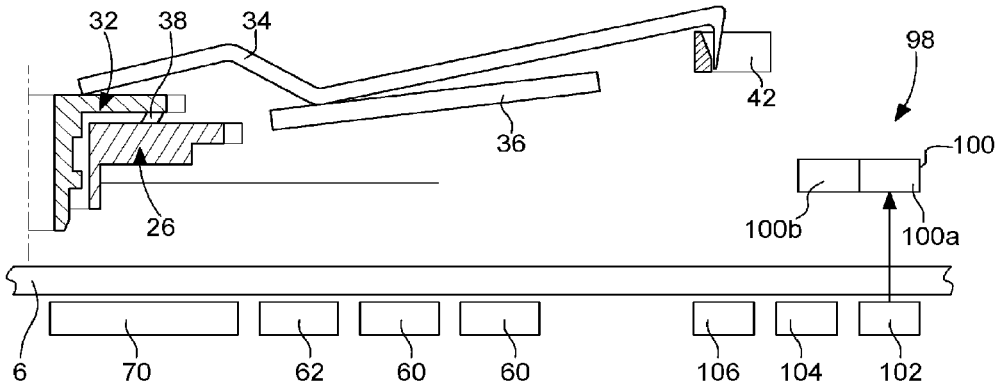
FIG. 14*a* is a partial schematic view of the wristwatch in the case where the mechanical striking device comprises a mechanical indicator member which indicates the non-set state of the mechanical striking device and wherein the electronic device comprises a light source and a light detector.
Figure 14B:
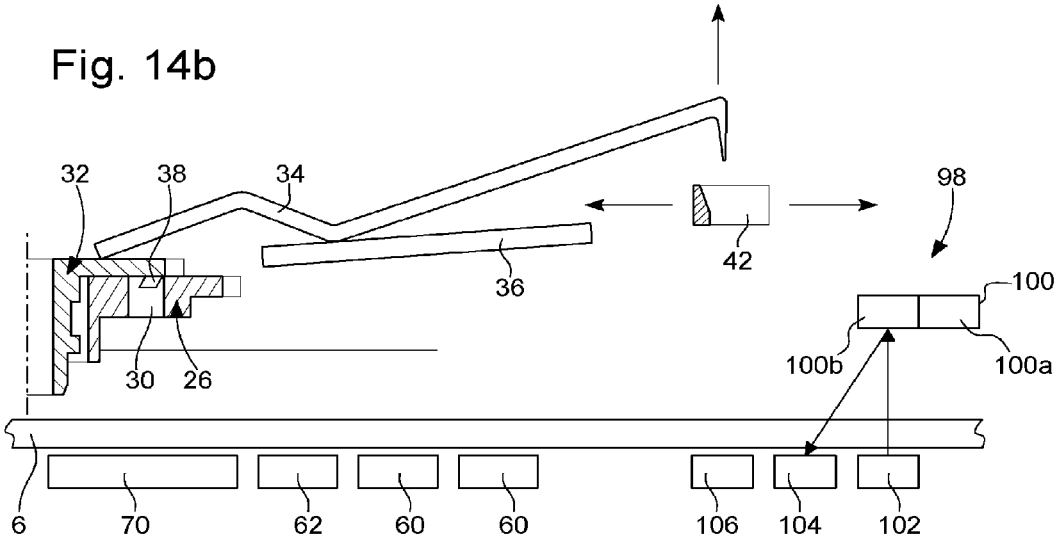
FIG. 14*b* is a similar view to that of FIG. 14*a* in the case where the mechanical indicator member indicates the set state of the mechanical striking device and where the light emitted by the light source is reflected by the reflective surface portion of the mechanical indicator member towards the light detector.

According to a first embodiment illustrated in FIG. 14*a*, mechanical indicator member 98 comprises a disc 100 having a first surface portion 100*a* which is absorbent and a second surface portion 100*b* which is reflective. This disc 100 is arranged to move between a first and a second position depending on whether mechanical device 20 is set or non-set. Electronic device 56 comprises a light source 102 such as a light emitting diode, and a light sensor 104 such as a photodiode, housed in bracelet 4 beneath disc 100. The light emitted by light source 102 will thus be absorbed or reflected depending on whether it falls on absorbent surface portion 100*a* or reflective surface portion 100*b* of disc 100. Finally, an image sensor 106, which may be of the same type as that described hereinbefore or simpler, scans for the moment when mechanical striking device 20 starts to operate.

The operation of this device is as follows. Light source 102 will, at regular intervals, send a light beam across disc 100. If, due to the absence of signal provided by light sensor 104, electronic device 56 observes that the light emitted by light source 102 falls on absorbent surface portion 100*a* of disc 100 and is therefore absorbed, it concludes that mechanical striking device 20 is not set. Consequently, it is not necessary for image sensor 106 to scan for the moment when mechanical striking mechanism 20 starts to operate, which saves energy. Indeed, light source 102 illuminates disc 100 less often than image sensor 106 scans for the moment when striking device 20 starts to operate. When the user sets mechanical striking device 20, for example by pressing a push-button, disc 100 will move such that the light emitted by light source 102 falls on the reflective surface portion 100*b* of disc 100. Thus, due to the signal provided by light sensor 104, electronic device 56 will note that the light emitted by light source 102 falls on the reflective surface portion 100*b* of disc 100 and is therefore reflected, and concludes that mechanical striking device 20 is set. At that moment, electronic device 56 cuts the electrical power to light source 102 and actuates image sensor 106. Image sensor 106 will then scan, at close regular intervals, for the moment when mechanical striking mechanism starts to operate. When mechanical striking device 20 starts to operate, the operation of mechanical striking device 20 and of electronic device 56 is the same as that described hereinbefore with reference to the first embodiment of the invention.

According to a second embodiment which is not shown, instead of having a reflective surface portion and an absorbent surface portion, disc 100 could be provided with a surface portion that reflects light towards light sensor 104 and a surface portion that reflects light in a direction in which light sensor 104 cannot sense light.

Figure 15A:
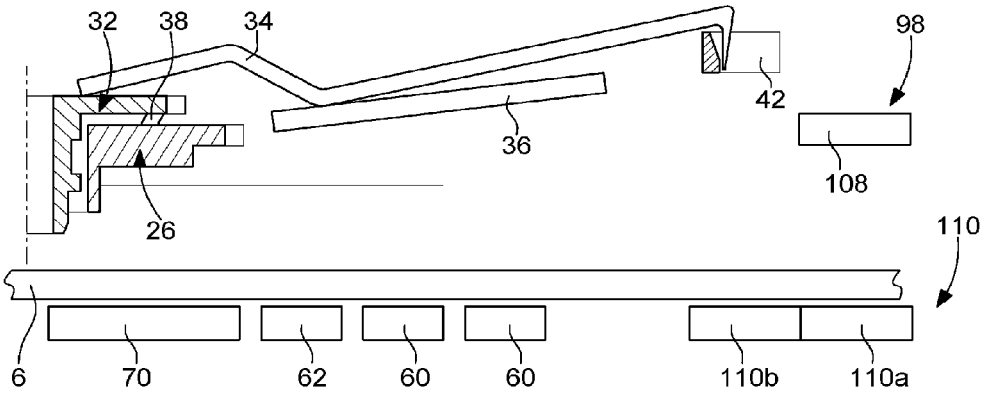
FIG. 15*a* is a partial schematic diagram of the wristwatch in the case where the mechanical striking device comprises a mechanical indicator member that indicates the non-set state of the mechanical striking device and wherein the electronic device comprises an image sensor having a first surface portion which is used to scan the indication provided by the mechanical indicator member, and a second surface portion used to scan the start of operation of the mechanical striking device.
Figure 15B:
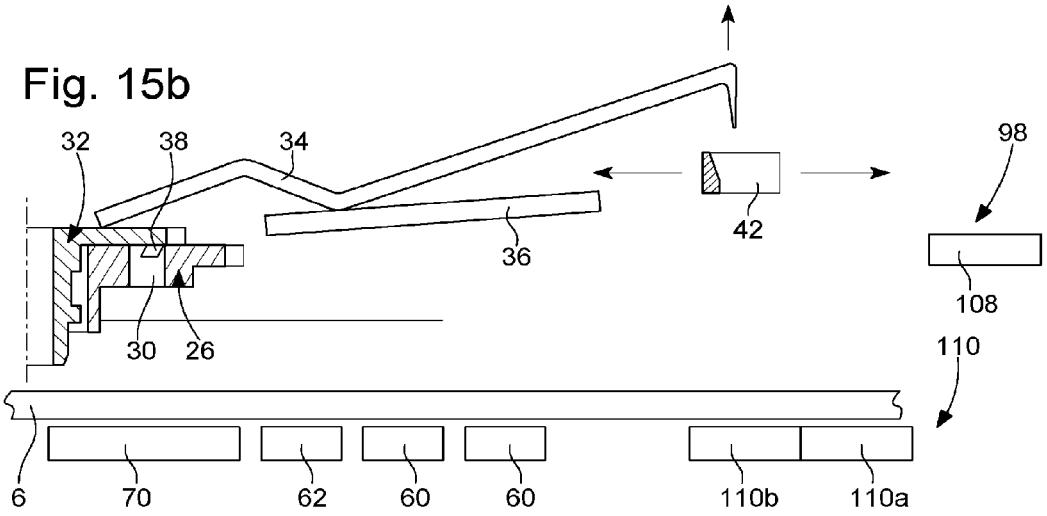
FIG. 15*b* is a similar view to that of FIG. 15*a* in the case where the mechanical indicator member moves aside, out of the field of vision of the image sensor when the mechanical striking device is set by the user.

According to a third embodiment (see FIG. 15*a*), the mechanical striking device comprises a mechanical indicator member 98, of the type of a disc 108 that indicates the non-set state of the mechanical striking device, and electronic device 56 comprises an image sensor 110 of the type described hereinbefore having a first surface portion 110*a*, which is used to scan the indication provided by mechanical indicator member 98, and a second surface portion 110*b* used to scan for the start of operation of mechanical striking device 20. It can, for example, be envisaged that disc 108 is visible to the first surface portion 110*a* of image sensor 110 when mechanical striking device 20 is in the non-set state, and then that disc 108 moves aside out of the field of vision of image sensor 110 when mechanical striking device 20 is set by the user (FIG. 15*b*). At that moment, electronic device 56 observes a change in the signal produced by image sensor 110 and will instruct image sensor 110 to scan mechanical striking device 20 by means of surface portion 110*b*.

Figure 16A:
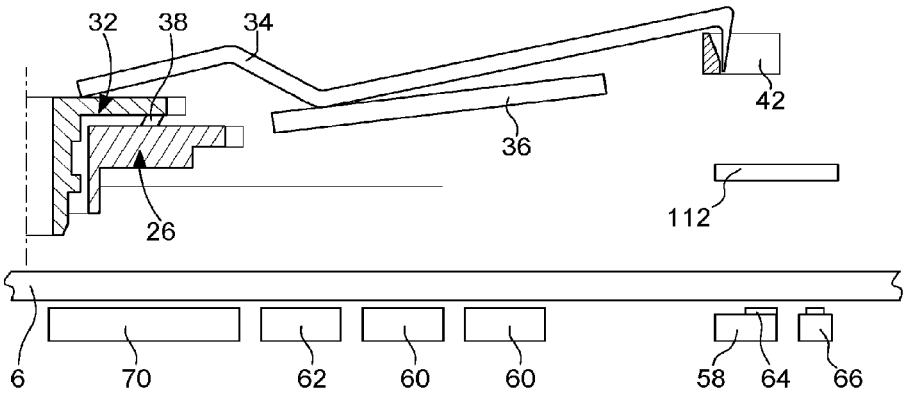
FIG. 16*a* is a partial schematic view of the wristwatch of the invention in the case where the mechanical striking device comprises a mechanical indicator member which conceals the mechanical striking device when the latter is not set.
Figure 16B:
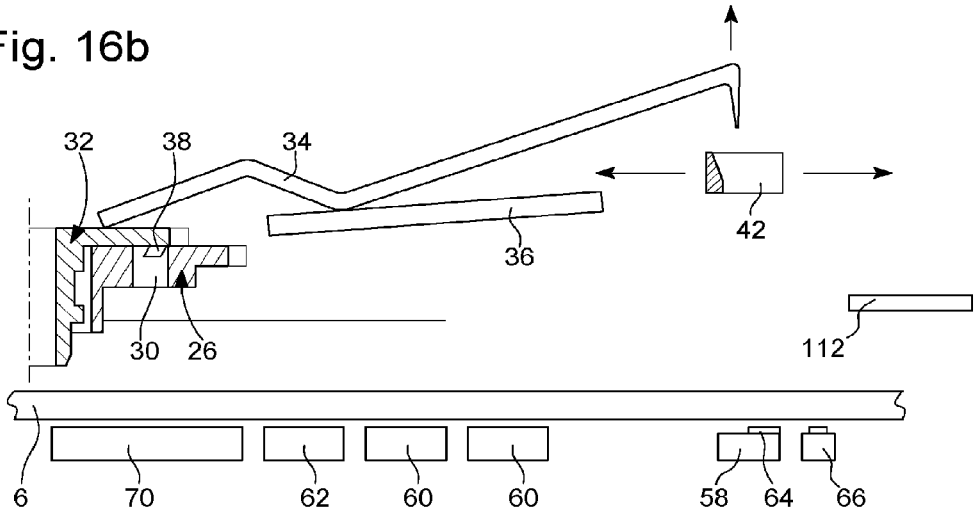
FIG. 16*b* is a similar view to that of FIG. 16*a* in the case where the mechanical indicator member has moved aside.

Finally, according to a last embodiment (FIG. 16*a*), the mechanical striking device includes a mechanical indicator member 112 which conceals mechanical striking device 20 from the view of image sensor 58 when said device is not set. When the user sets mechanical striking device 20 (FIG. 16*b*), mechanical indicator member 112 moves aside and control unit 60 detects a change in the signal provided by image sensor 58. In response to this change, control unit 60 instructs image sensor 58 to scan mechanical striking device 20 to detect the start of operation thereof.

It goes without saying that the present invention is not limited to the embodiments that have just been described and that various simple modifications and variants can be envisaged by those skilled in the art without departing from the scope of the invention as defined by the annexed claims. It will be noted, in particular, that it is possible to envisage offsetting in time, by a fixed duration or user-selectable duration, the activation of the second acoustic alarm signal. In other words, the production of the second acoustic signal generated by the electronic device will be offset in time with respect to the emission of the first acoustic signal produced by the mechanical device. It will also be understood that the electronic device emits a second acoustic alarm signal or, equally, a mechanical vibration through the use of a vibrating mechanism housed in the thickness of the bracelet. At the moment when the mechanical device starts to produce the first acoustic alarm signal, the electronic device will activate the vibrating mechanism which will generate vibrations that the user will feel on his wrist. The vibrating mechanism is typically an eccentric mechanism which activates an inertia block. Likewise, it will be noted that, in a simplified variant of the invention, it may be envisaged to set the duration of the second alarm in advance. Once started after the activation of the first alarm, the second alarm will stop independently once this time has elapsed. In other words, the second alarm will be activated at the moment when the first alarm starts to operate and will stop at the end of a predefined time, independent of the duration of activation of the first alarm. It will also be noted that, in the case where the sensor is a microphone or an accelerometer, it is not essential for such a sensor to be disposed beneath the watch case back. Consequently, it is possible to envisage a bracelet formed of two separate strands, each fixed via one end thereof to the watch case, and in which are incorporated the components necessary for implementation of the invention. Finally, it will be noted that the present invention also covers a method for generating an acoustic alarm signal in a wristwatch comprising a watch case 2 in which is housed a mechanical timepiece movement 18 comprising a mechanical striking device 20 arranged to produce a first acoustic alarm signal, watch case 2 being associated with a bracelet 4 in which is housed an electronic device 56 for producing a second acoustic alarm signal and/or a mechanical vibration, electronic device 56 being arranged to produce the second acoustic alarm signal at the moment when mechanical device 20 for executing the first mechanical function produces the first acoustic alarm signal or after a predefined duration or user-selectable duration following the start of operation of mechanical device 20.

LIST OF PARTS

Wristwatch 1
Watch case 2
Bracelet 4
Case back 6
Crystal 8
Dial 10
Hour hand 12, minute hand 14 and seconds hand 16
Mechanical timepiece movement 18
Mechanical striking device 20
Winding stem 22
First, second and third intermediate wheels 24*a*, 24*b* and 24*c*
Release wheel 26
Index 28
Three openings 30
Hour wheel 32
Release lever 34
Spring 36
Three catches 38
Inclined plane 40
Strike pallets 42
Strike wheel 44
Pivot point 46
Hammer 48
Rocking lever 50
Slide lever 52
Strike lock 54
Electronic device 56
Image sensor 58
Control unit 60
Electronic sound generator 62
Collimator lens 64
Light source 66
Printed circuit sheet 68
Electrical current source 70
Openings 72, 74
Capacitive sensor 76
RC oscillator 78
Demodulator 80
Output stage 82
Reed switch 84
Flexible reeds 86
Magnet 88
Inductive sensor 90
Winding 92
Magnetic circuit 94
Microphone 96
Mechanical indicator member 98
Disc 100
First absorbent surface portion 100*a*
Second reflective surface portion 100*b*
Light source 102
Light sensor 104
Image sensor 106
Disc 108
Image sensor 110
First surface portion 110*a*
Second surface portion 110*b*
Mechanical indicator member 112

What is claimed is:

1. A wristwatch comprising a watch case in which is housed a mechanical timepiece movement including a mechanical device for executing at least a first mechanical function, wherein the watch case is associated with a bracelet or strap in which is housed an electronic device arranged to execute at least a second electronic function, wherein the execution of the second electronic function is dependent on the execution of the first mechanical function.

2. The wristwatch according to claim 1, wherein the mechanical device for executing the first mechanical function is a mechanical striking device arranged to produce a first acoustic alarm signal, and wherein the electronic device housed in the bracelet is arranged to produce a second acoustic alarm signal and/or a mechanical vibration, wherein the electronic device is arranged to produce the second acoustic alarm signal at the moment when the mechanical striking device produces the first acoustic alarm signal or after a predefined or user-selectable duration following the start of operation of the mechanical striking device.

3. The wristwatch according to claim 2, comprising a transparent case back, wherein the electronic device for executing the second electronic function includes an image sensor arranged in the bracelet so as to be located beneath the transparent case back and capable of detecting the start of motion of a movable element of the mechanical striking device.

4. The wristwatch according to claim 3, wherein the image sensor is arranged to be capable of detecting a change in the levels of grey in an image scanned by the sensor.

5. The wristwatch according to claim 4, wherein the image sensor is of the CMOS type.

6. The wristwatch according to claim 3, wherein the electronic device for executing the second electronic function includes a light source arranged in the bracelet in order to improve the conditions in which the image sensor takes shots.

7. The wristwatch according to claim 3, wherein the image sensor is arranged to send an electrical signal to an electronic control unit that is arranged to actuate an electronic sound or vibration generator as soon as the image sensor detects that the mechanical striking device starts to operate and emits the first acoustic alarm signal.

8. The wristwatch according to claim 7, wherein the image sensor is arranged to send an electrical signal to the electronic control unit that is arranged to stop the electronic sound or vibration generator when the movable element scanned by the image sensor stops and when the first acoustic alarm signal stops.

9. The wristwatch according to claim 3, wherein the image sensor is covered by a collimator lens.

10. The wristwatch according to claim 1 comprising an opaque non-electrically conductive case back, wherein the electronic device for executing the second electronic function includes a capacitive sensor, a magnetic sensor or an inductive sensor arranged in the bracelet so as to be located beneath the opaque non-electrically conductive case back and capable of detecting the start of motion of a movable element of the mechanical device.

11. The wristwatch according to claim 2 comprising an opaque non-electrically conductive case back, wherein the electronic device for executing the second electronic function includes a capacitive sensor, a magnetic sensor or an inductive sensor arranged in the bracelet so as to be located beneath the opaque non-electrically conductive case back and capable of detecting the start of motion of a movable element of the mechanical device.

12. The wristwatch according to claim 10, wherein the capacitive sensor includes an RC oscillator, a demodulator and an output stage that are arranged to send an electrical signal to an electronic control unit that is arranged to actuate an electronic sound or vibration generator as soon as the capacitive sensor detects a capacitance change caused by the start of operation of the mechanical device for executing the first mechanical function and the emission of a first acoustic alarm signal.

13. The wristwatch according to claim 11, wherein the capacitive sensor includes an RC oscillator, a demodulator and an output stage that are arranged to send an electrical signal to an electronic control unit that is arranged to actuate an electronic sound or vibration generator as soon as the capacitive sensor detects a capacitance change caused by the start of operation of the mechanical device for executing the first mechanical function and the emission of a first acoustic alarm signal.

14. The wristwatch according to claim 10, wherein the magnetic sensor is a reed switch with flexible reeds that is arranged to send an electrical signal to an electronic control unit that is arranged to actuate an electronic sound or vibration generator as soon as the flexible reeds attract each other and come into contact with each other as a result of the displacement of a magnet which starts to move when the mechanical device for executing the first mechanical function starts to operate.

15. The wristwatch according to claim 11, wherein the magnetic sensor is a reed switch with flexible reeds that is arranged to send an electrical signal to an electronic control unit that is arranged to actuate an electronic sound or vibration generator as soon as the flexible reeds attract each other and come into contact with each other as a result of the displacement of a magnet which starts to move when the mechanical device for executing the first mechanical function starts to operate.

16. The wristwatch according to claim 10, wherein the magnetic sensor is a giant magnetoresistive sensor that is arranged to send an electrical signal to an electronic control unit which is arranged to actuate an electronic sound or vibration generator as soon as the electrical resistance of the sensor varies as a result of the displacement of a magnet which starts to move when the mechanical device for executing the first mechanical function starts to operate.

17. The wristwatch according to claim 11, wherein the magnetic sensor is a giant magnetoresistive sensor that is arranged to send an electrical signal to an electronic control unit which is arranged to actuate an electronic sound or vibration generator as soon as the electrical resistance of the sensor varies as a result of the displacement of a magnet which starts to move when the mechanical device for executing the first mechanical function starts to operate.

18. The wristwatch according to claim 10, wherein the inductive sensor includes a winding made around a magnetic circuit and is arranged to send an electrical signal to an electronic control unit that is arranged to actuate an electronic sound or vibration generator soon as an electrical current is induced in the winding as a result of the displacement of a magnet which starts to move when the mechanical device for executing the first mechanical function starts to operate.

19. The wristwatch according to claim 11, wherein the inductive sensor includes a winding made around a magnetic circuit and is arranged to send an electrical signal to an electronic control unit that is arranged to actuate an electronic sound or vibration generator soon as an electrical current is induced in the winding as a result of the displacement of a magnet which starts to move when the mechanical device for executing the first mechanical function starts to operate.

20. The wristwatch according to claim 10, wherein the inductive sensor includes an LC oscillator circuit arranged to send an electrical signal to an electronic control unit that is arranged to actuate an electronic sound or vibration generator as soon as the inductance varies as a result of the displacement of a movable metal element of the mechanical device for executing the first mechanical function.

21. The wristwatch according to claim 11, wherein the inductive sensor includes an LC oscillator circuit arranged to send an electrical signal to an electronic control unit that is arranged to actuate an electronic sound or vibration generator as soon as the inductance varies as a result of the displacement of a movable metal element of the mechanical device for executing the first mechanical function.

22. The wristwatch according to claim 1, wherein the electronic device for executing the second electronic function includes a microphone arranged to detect an acoustic wave produced by the start of operation of the mechanical device for executing the first mechanical function and to send an electrical signal to an electronic control unit which actuates an electronic sound or vibration generator.

23. The wristwatch according to claim 2, wherein the electronic device for executing the second electronic function includes a microphone arranged to detect an acoustic wave produced by the start of operation of the mechanical device for executing the first mechanical function and to send an electrical signal to an electronic control unit which actuates an electronic sound or vibration generator.

24. The wristwatch according to claim 1, wherein the electronic device for executing the second electronic function includes an accelerometer arranged to detect the mechanical vibrations generated by the start of operation of the mechanical device for executing a first mechanical function and to send an electrical signal to an electronic control unit which actuates an electronic sound or vibration generator.

25. The wristwatch according to claim 2, wherein the electronic device for executing the second electronic function includes an accelerometer arranged to detect the mechanical vibrations generated by the start of operation of the mechanical device for executing a first mechanical function and to send an electrical signal to an electronic control unit which actuates an electronic sound or vibration generator.

26. The wristwatch according to claim 1, wherein the mechanical device for executing the first mechanical function includes a mechanical indicator member that provides an indication as to whether the mechanical device for executing the first mechanical function is in a set or non-set state, and wherein the electronic device includes means arranged to scan the indication provided by the mechanical indicator member and means which are arranged to detect the moment at which the first mechanical function will start.

27. The wristwatch according to claim 2, wherein the mechanical device for executing the first mechanical function includes a mechanical indicator member that provides an indication as to whether the mechanical device for executing the first mechanical function is in a set or non-set state, and wherein the electronic device includes means arranged to scan the indication provided by the mechanical indicator member and means which are arranged to detect the moment at which the first mechanical function will start.

28. The wristwatch according to claim 26, wherein the mechanical indicator member includes a disc having a first surface portion that is absorbent and a second surface portion that is reflective, wherein the disc is arranged to move between a first and a second position depending on whether the mechanical device is non-set or set, and wherein the means arranged to scan the indication provided by the mechanical indicator member comprise a light source and a light sensor housed in the bracelet, beneath the disc, wherein the light emitted by the light source is absorbed or reflected depending on whether the light falls on the first absorbent surface portion or on the second reflective surface portion of the disc, wherein the means arranged to detect the moment at which the first mechanical function is going to start, includes an image sensor capable of detecting the start of motion of a movable element of the mechanical device, and starts to scan for the moment when the mechanical device will start to operate when the light sensor senses the light reflected by the second reflective surface portion of the disc.

29. The wristwatch according to claim 26, wherein the means arranged to scan the indication provided by the mechanical indicator member include a light source and a light sensor housed in the bracelet, beneath a disc having a first surface portion that reflects light in the direction in which the light sensor cannot sense light and a second surface portion that reflects light in the direction of the light sensor), wherein the disc is arranged to move between a first and a second position depending on whether the mechanical device is non-set or set, wherein the light emitted by the light source is thus deviated or reflected depending on whether the light falls on the first surface portion or on the second surface portion of the disc, wherein the means arranged to detect the moment at which the first mechanical function will start include an image sensor capable of detecting the start of motion of a movable element of the mechanical device and starts to scan for the moment when the mechanical device will start to operate when the light sensor senses the light reflected by the disc.

30. The wristwatch according to claim 26, wherein the electronic device comprises an image sensor having, respectively, a first surface portion that is used to scan the indication provided by the mechanical indicator member, and a second surface portion used to detect the start of operation of the mechanical device.

31. A method for generating an acoustic alarm signal in a wristwatch that includes a watch case in which is housed a mechanical timepiece movement that includes a mechanical striking device arranged to produce a first acoustic alarm signal, wherein the watch case is associated with a bracelet in which is housed an electronic device for producing a second acoustic alarm signal and/or a mechanical vibration, wherein the method has the step of producing the second acoustic alarm signal at the moment when the first acoustic alarm signal is produced or after a predefined or user-selectable duration following the start of operation of the mechanical device.

* * * * *